US012144479B2

(12) United States Patent
Eisenbart et al.

(10) Patent No.: US 12,144,479 B2
(45) Date of Patent: Nov. 19, 2024

(54) DOMESTIC DISHWASHING MACHINE AND METHOD

(71) Applicant: BSH Hausgeräte GmbH, Munich (DE)

(72) Inventors: Bernd Eisenbart, Holzheim (DE); Vitus Hörmann, Glött (DE); Bernd Kränzle, Dischingen (DE)

(73) Assignee: BSH Hausgeräte GmbH, Munich (DE)

( * ) Notice: Subject to any disclaimer, the term of this patent is extended or adjusted under 35 U.S.C. 154(b) by 296 days.

(21) Appl. No.: 17/784,123

(22) PCT Filed: Dec. 2, 2020

(86) PCT No.: PCT/EP2020/084245
§ 371 (c)(1),
(2) Date: Jun. 10, 2022

(87) PCT Pub. No.: WO2021/115870
PCT Pub. Date: Jun. 17, 2021

(65) Prior Publication Data

US 2023/0022919 A1 Jan. 26, 2023

(30) Foreign Application Priority Data

Dec. 13, 2019 (DE) ..... 102019219605.5

(51) Int. Cl.
*A47L 15/42* (2006.01)
*A47L 15/00* (2006.01)

(52) U.S. Cl.
CPC ..... *A47L 15/4221* (2013.01); *A47L 15/0021* (2013.01); *A47L 2401/06* (2013.01)

(58) Field of Classification Search
CPC ..... A47L 15/4221; A47L 15/0021; A47L 2401/06
USPC ..... 134/56 D
See application file for complete search history.

(56) References Cited

U.S. PATENT DOCUMENTS

2012/0138110 A1 6/2012 Chen
2013/0008477 A1 1/2013 Forst
2015/0305592 A1 10/2015 Pers

FOREIGN PATENT DOCUMENTS

DE 102017217989 A1 4/2019
EP 2672875 B1 * 4/2015 ..... A47L 15/0023

OTHER PUBLICATIONS

EP2672875B1—machine translation (Year: 2015).*
National Search Report DE 10 2019 219 605.5 dated Sep. 28, 2020.
International Search Report PCT/EP2020/084245 dated Jan. 20, 2021.

* cited by examiner

*Primary Examiner* — Tinsae B Ayalew
(74) *Attorney, Agent, or Firm* — Michael E. Tschupp; Andre Pallapies; Brandon G. Braun

(57) ABSTRACT

A household dishwasher includes a dishwasher cavity for receiving an item to be washed, a hydraulic circuit configured to circulate fresh water and/or wash liquor in the dishwasher cavity, a pump device configured to apply fresh water and/or wash liquor to the hydraulic circuit, and a closure manufactured from a water-soluble material. The closure is configured to disconnect part of the hydraulic circuit from the pump device during a one-time calibration process of the household dishwasher and dissolves in the fresh water and/or the wash liquor during and/or after completion of the calibration process.

16 Claims, 4 Drawing Sheets

DOMESTIC DISHWASHING MACHINE AND METHOD

CROSS-REFERENCES TO RELATED APPLICATIONS

This application is the U.S. National Stage of International Application No. PCT/EP2020/084245, filed Dec. 2, 2020, which designated the United States and has been published as International Publication No. WO 2021/115870 A1 and which claims the priority of German Patent Application, Serial No. 10 2019 219 605.5, filed Dec. 13, 2019, pursuant to 35 U.S.C. 119(a)-(d).

The contents of International Application No. PCT/EP2020/084245 and German Patent Application, Serial No. 10 2019 219 605.5 are incorporated herein by reference in their entireties as if fully set forth herein.

BACKGROUND OF THE INVENTION

The present invention relates to a household dishwasher and a method for calibrating a household dishwasher of this type.

A dishwasher has a dishwasher cavity in which items to be washed can be received. Spray zones can be provided in the dishwasher cavity in order to apply fresh water and/or wash liquor to the items to be washed. The spray zones can be embodied as spray arms mounted in a rotatable manner in or on the dishwasher cavity. Furthermore, spray zones in the form of what are known as intensive spray zones can also be provided. An intensive spray zone of this type can be provided for instance on a receptacle for items to be washed which can be received in the dishwasher cavity. Very dirty items to be washed can be cleaned in a targeted manner with the aid of the intensive spray zone, for instance. To this end, the intensive spray zone can be activated and deactivated manually with the aid of a valve.

The motor current of a circulating pump of the dishwasher can be used in order to be able to detect whether an intensive spray zone of this type to be actuated manually is active or inactive. To this end, a calibration of the dishwasher which is carried out with a defined hydraulic state is required during commissioning, however. A defined hydraulic state of this type is a state in which the intensive spray zone is deactivated. In other words, for commissioning the dishwasher, it is necessary for a user of the dishwasher to manually deactivate the intensive spray zone.

BRIEF SUMMARY OF THE INVENTION

Against this background, one object of the present invention consists in providing an improved household dishwasher.

Accordingly, a household dishwasher is proposed with a dishwasher cavity for receiving items to be washed, a hydraulic circuit for circulating fresh water and/or wash liquor in the dishwasher cavity, a pump device for applying fresh water and/or the wash liquor to the hydraulic circuit and a closure manufactured from a water-soluble material. Here the closure disconnects part of the hydraulic circuit from the pump device during a one-time calibration process of the household dishwasher. The closure dissolves in the fresh water and/or the wash liquor during and/or after completion of the calibration process.

As a result of the closure being provided, a defined hydraulic state of the hydraulic circuit can be established. With the aid of the closure, an intensive spray zone, as mentioned before, or also any other spray zone can be deactivated for the calibration process, for instance. In other words, a user does not need to make any arrangements for the calibration process or for a commissioning of the household dishwasher. This simplifies the operation of the household dishwasher.

The dishwasher cavity is preferably cuboid. The dishwasher cavity can be closed with the aid of a door attached in a pivotable manner to the dishwasher cavity. A number of receptacles for items to be washed, for instance a bottom basket, a top basket and a cutlery drawer, can be provided in the dishwasher cavity. The items to be washed, which are applied with fresh water and/or wash liquor with the aid of the hydraulic circuit, can be received in the receptacles for items to be washed. "Wash liquor" is to be understood here to mean water containing a detergent and/or dirt particles removed from the items to be washed.

The pump device is preferably a circulating pump of the household dishwasher. The pump device can be provided in particular on a pump sump of the dishwasher cavity. The pump sump is in turn arranged on a base of the dishwasher cavity. The fact that the pump device "applies" fresh water and/or wash liquor to the hydraulic circuit means here that the pump device pumps the fresh water and/or the wash liquor through the hydraulic circuit. The pump device can, but need not, be part of the hydraulic circuit.

The calibration process is preferably carried out when the household dishwasher is being commissioned. The fact that part of the hydraulic circuit is "disconnected" from the pump device means here in particular that the closure separates part of the hydraulic circuit fluidically from the pump device. In other words, the pump device is not able to pump fresh water and/or wash liquor into this part of the hydraulic circuit. The closure is preferably completely dissolved after completion of the calibration process. The residues of the closure may however also only completely dissolve in subsequent wash cycles.

According to one embodiment, the hydraulic circuit has a number of spray zones, wherein the closure disconnects at least one of the spray zones from the pump device.

The spray zones can be embodied as spray arms mounted in or on the dishwasher cavity, for example. The spray zones can however also comprise one or more what are known as intensive spray zones, which are arranged for instance on a receptacle for items to be washed, as explained previously. The closure is suited to disconnecting a spray zone, embodied as a spray arm or as an intensive spray zone, from the pump device. The closure can also disconnect a number of spray zones from the pump device.

According to a further embodiment, the at least one spray zone disconnected from the pump device with the aid of the closure can be brought from an activated state into a deactivated state with the aid of a valve.

The valve is preferably a switching valve. A "switching valve" or an "on-off valve" is to be understood here to mean in particular a valve which enables the spray zone to toggle to and fro between the activated state and the deactivated state, without intermediate positions being able to be reached. The valve is preferably a valve that is to be actuated manually. Alternatively, the valve can however also be actuated electrically. For instance, the valve can be a solenoid valve.

According to a further embodiment, the closure is arranged upstream of the valve.

"Upstream" is to be understood here to mean that the closure is arranged in front of the valve in a flow direction of the fresh water and/or the wash liquor. This is advantageous in that the closure can then dissolve both when the valve is opened and also when the valve is closed. The closure can however also be arranged downstream of the valve. In this case, the closure only dissolves when the valve is opened and the spray zone is in its activated state. "Downstream" means here that the closure is arranged after the valve in the flow direction of the fresh water and/or the wash liquor.

According to a further embodiment, the at least one spray zone disconnected from the pump device with the aid of the closure is an intensive spray zone.

The intensive spray zone can also be referred to as an intensive wash zone. The intensive spray zone can, as mentioned previously, be arranged on one of the receptacles for items to be washed, for instance. The intensive spray zone can, however, also be positioned on side walls of the dishwasher cavity, on a ceiling of the same or on a rear wall of the dishwasher cavity. The spray zones disconnected from the pump device with the aid of the closure are preferably spray arms. This is not obligatory, however.

According to a further embodiment, the at least one spray zone disconnected from the pump device with the aid of the closure and a further spray zone are connected to the pump device with the aid of a shared supply line.

In particular, the supply line splits into branches in front of the two spray zones. To this end a distribution element can be provided. Alternatively, the two spray zones can also have a separate supply line in each case.

According to a further embodiment, the closure is arranged between the spray zone disconnected from the pump device with the aid of the closure and the supply line.

In other words, that spray zone which is not disconnected from the pump device with the aid of the closure can continue to be supplied with fresh water and/or wash liquor with the aid of the supply line.

According to a further embodiment, the household dishwasher further comprises a water switch arranged downstream of the pump device for activating and deactivating the spray zones.

The water switch can preferably be controlled with the aid of a control device of the household dishwasher. The water switch is suited to supplying fresh water and/or wash liquor in a targeted manner to individual spray zones or simultaneously to all spray zones. The water switch is arranged in particular between the pump device and the spray zones.

According to a further embodiment, the household dishwasher further comprises a control device for detecting a motor current of the pump device during the calibration process.

The motor current changes depending on which spray zone is active or inactive. As a result of part of the hydraulic circuit being disconnected from the pump device with the aid of the closure, as mentioned previously a defined hydraulic state can be generated, in which a reference operating point of the pump device is detected for instance when fresh water and/or wash liquor is/are applied to the disconnected spray zone or the disconnected spray zones.

According to a further embodiment, the closure is manufactured from a water-soluble plastic material, in particular from polyvinyl alcohol.

The closure can however be manufactured from any other water-soluble material. For instance, the closure can also be manufactured from salt, sugar or wax.

Furthermore, a method is proposed for calibrating a household dishwasher with a dishwasher cavity for receiving items to be washed, a hydraulic circuit for circulating fresh water and/or wash liquor in the dishwasher cavity and a pump device for applying fresh water and/or wash liquor to the hydraulic circuit. Here the method comprises the following steps: a) disconnecting part of the hydraulic circuit from the pump device during an initial calibration process of the household dishwasher with the aid of a closure manufactured from a water-soluble material and b) dissolving the closure in the fresh water and/or wash liquor during and/or after completion of the calibration process.

The method is suited in particular to calibrating or commissioning a household dishwasher, as described above. The method can be referred to as a calibration method or as a commissioning method. Steps a) and b) can be carried out consecutively or simultaneously.

According to one embodiment, in step b) the closure dissolves as a function of a temperature of the fresh water and/or the wash liquor and/or a duration of a contact of the closure with the fresh water and/or the wash liquor.

It is possible in this way, for instance, to dissolve the closure completely and in a targeted manner toward the end of the calibration process with the aid of a suitable temperature control.

According to a further embodiment, in step a) at least one spray zone of a number of spray zones of the hydraulic circuit is disconnected from the pump device with the aid of the closure.

In particular, an intensive spray zone, as mentioned previously, is disconnected from the other spray zones.

According to a further embodiment, in step a) the closure is arranged in or on a supply line of the at least one spray zone disconnected from the pump device with the aid of the closure.

The arrangement of the closure can be carried out for instance before the household dishwasher is assembled. In particular, the arrangement of the closure can be carried out at a supplier's premises.

According to a further embodiment, a motor current of the pump device is detected during the calibration process with the aid of a control device.

During operation of the household dishwasher, the control device can identify, with the aid of monitoring and/or evaluation of the motor current, which of the spray zones is active and which of the spray zones is inactive.

Further possible aspects of the household dishwasher and/or of the method also comprise combinations—not explicitly mentioned—of features or embodiments described above or below in respect of the exemplary embodiments. In such cases the person skilled in the art will also add individual aspects as improvements or amendments to the respective basic form of the household dishwasher and/or the method.

BRIEF DESCRIPTION OF THE DRAWINGS

Further advantageous embodiments and aspects of the household dishwasher and/or the method form the subject matter of the subclaims and of the exemplary embodiments of the household dishwasher and/or the method described below. The household dishwasher and/or the method are further explained in greater detail below on the basis of preferred embodiments with reference to the appended figures.

DETAILED DESCRIPTION OF EXEMPLARY EMBODIMENTS OF THE PRESENT INVENTION

Figure 1:
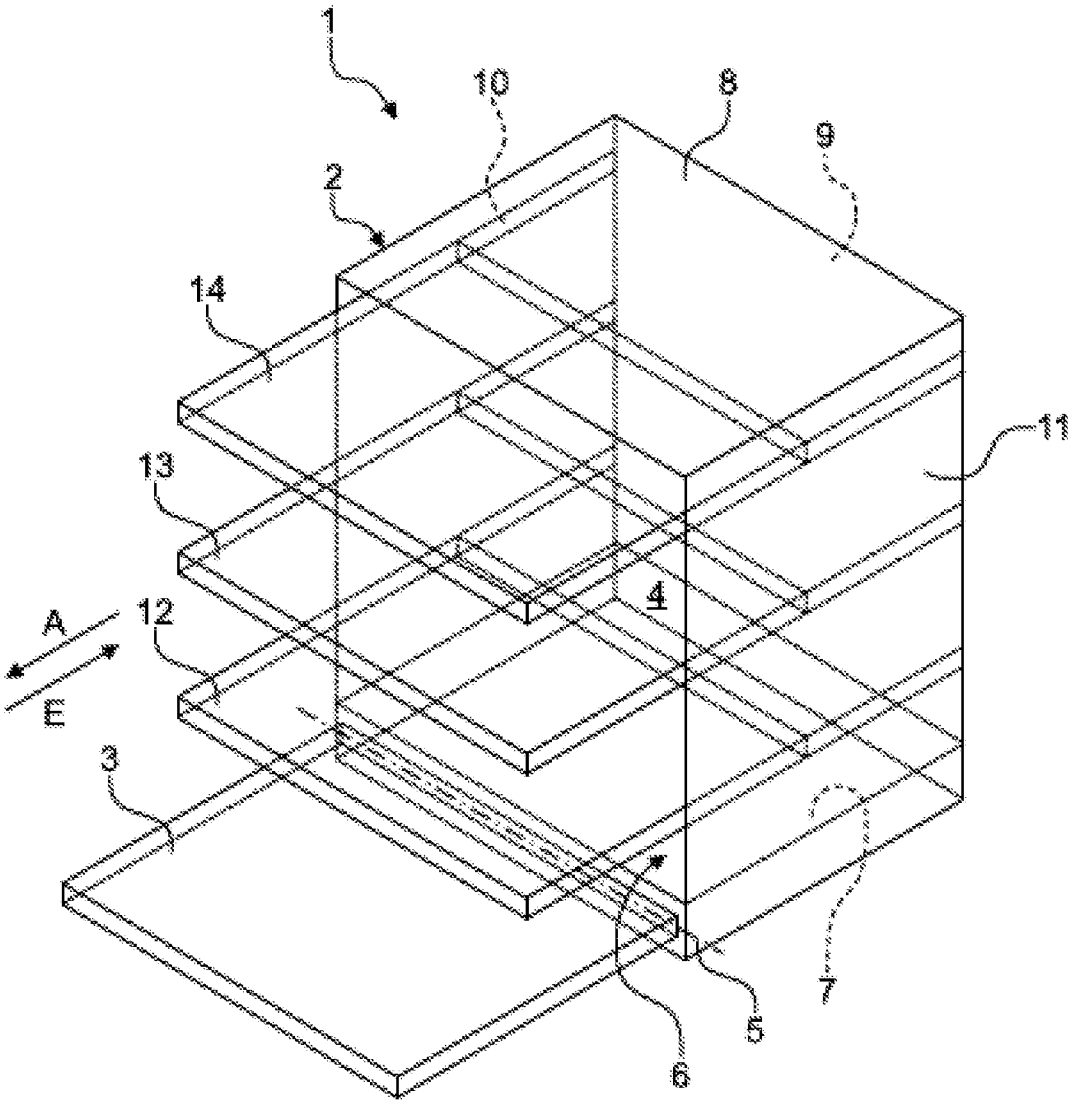
FIG. 1 shows a schematic perspective view of an embodiment of a household dishwasher.

In the figures, elements that are identical or have the same function have been provided with the same reference characters unless otherwise stated.

FIG. 1 shows a schematic perspective view of an embodiment of a household dishwasher 1. The household dishwasher 1 comprises a dishwasher cavity 2, which can be closed by a door 3, in particular in a watertight manner. To this end, a sealing device can be provided between the door 3 and the dishwasher cavity 2. The dishwasher cavity 2 is preferably cuboid. The dishwasher cavity 2 can be arranged in a housing of the household dishwasher 1. The dishwasher cavity 2 and the door 3 can form a dishwasher interior 4 for washing items to be washed.

The door 3 is shown in its opened position in FIG. 1. The door 3 can be closed or opened by pivoting about a pivot axis 5 provided on a lower end of the door 3. A loading opening 6 of the dishwasher cavity 2 can be closed or opened with the aid of the door 3. The dishwasher cavity 2 has a base 7, a ceiling 8 arranged opposite to the base 7, a rear wall 9 arranged facing the closed door, 3 and two side walls 10, 11 arranged facing one another. The base 7, the ceiling 8, the rear wall 9 and the side walls 10, 11 can be manufactured from a stainless-steel sheet, for example. Alternatively, the base 7 can be manufactured from a plastic material, for example.

Furthermore, the household dishwasher 1 has at least one receptacle 12 to 14 for items to be washed. A number of, for instance three, receptacles 12 to 14 for items to be washed can preferably be provided, wherein the receptacle 12 for items to be washed can be a lower receptacle for items to be washed or a bottom basket, the receptacle 13 for items to be washed can be an upper receptacle for items to be washed or an upper basket, and the receptacle 14 for items to be washed can be a cutlery drawer. As additionally shown in FIG. 1, the receptacles 12 to 14 for items to be washed are arranged one above the other in the dishwasher cavity 2. Each receptacle 12 to 14 for items to be washed is optionally able to be shifted into or out of the dishwasher cavity 2. In particular, each receptacle 12 to 14 for items to be washed is able to be inserted or pushed into the dishwasher cavity 2 in an insertion direction E and extracted or pulled out from the dishwasher cavity 2 in an extraction direction A opposite to the insertion direction E.

Figure 2:
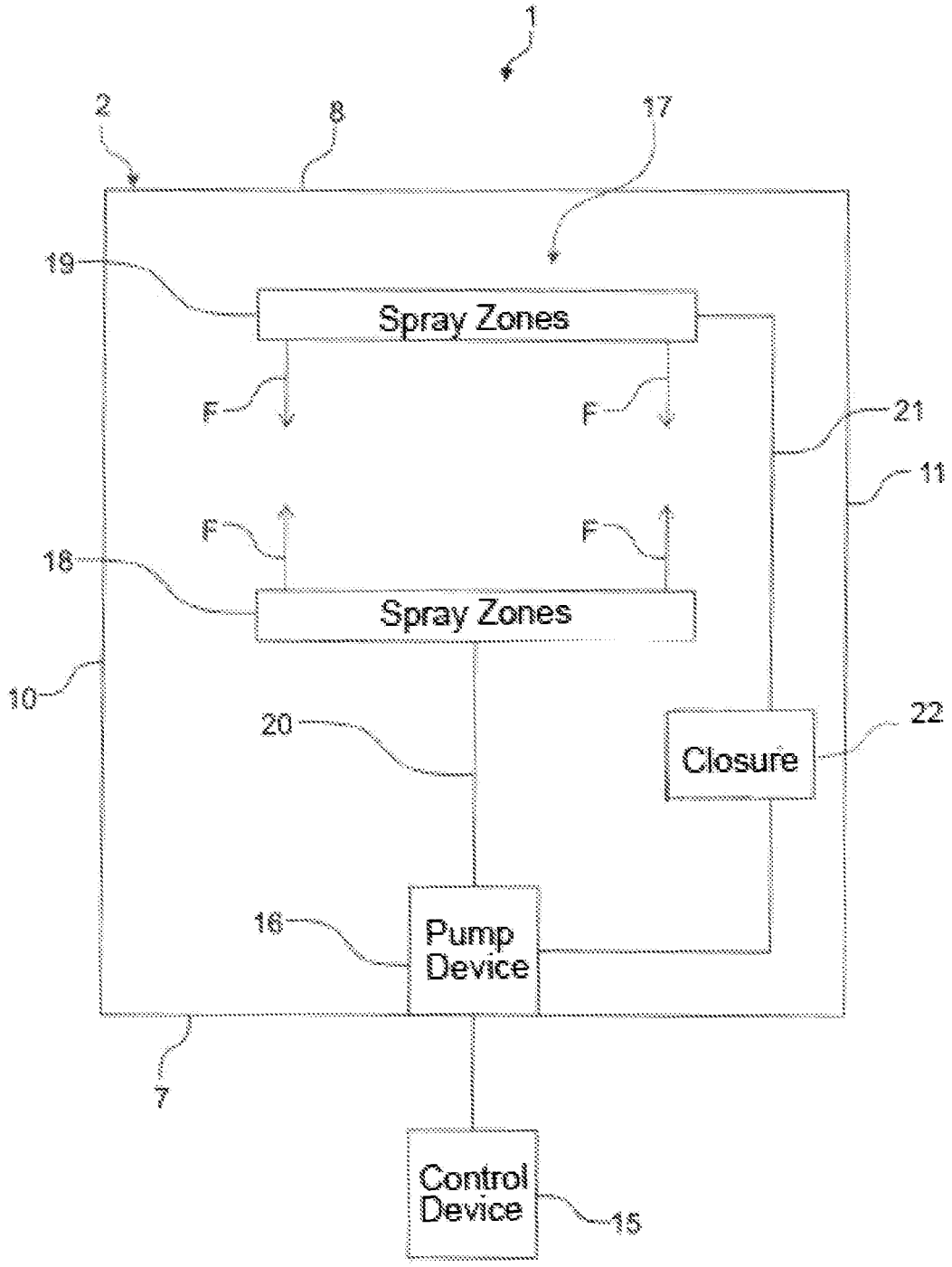
FIG. 2 shows a very schematic view of the household dishwasher according to FIG. 1.

FIG. 2 shows a very schematic view of the household dishwasher 1. The household dishwasher 1 comprises a control device 15. The control device 15 is preferably a regulating and control device. Different washing programs of the household dishwasher 1 can be carried out with the aid of the control device 15, for instance. To this end, washing programs can be stored or saved in the control device 15. The control device 15 is preferably arranged outside of the dishwasher cavity 2. The control device 15 can be arranged in or on the door 3. The control device 15 is preferably provided on an upper edge of the door 3. The control device 15 can be controlled or actuated with the aid of control elements (not shown). The control elements can comprise keys, buttons and/or touchscreens, for instance.

The household dishwasher 1 further comprises a pump device 16. The pump device 16 is a circulating pump. The pump device 16 can be arranged on a pump sump (not shown) of the dishwasher cavity 2. The pump sump is provided on the base 7 of the dishwasher cavity 2. The pump device 16 can be arranged in or on the pump sump. The pump device 16 is preferably arranged outside of the dishwasher cavity 2. The pump device 16 can however also be arranged at least partially within the dishwasher cavity 2.

Furthermore, the household dishwasher 1 comprises a hydraulic circuit 17 for circulating fresh water and/or wash liquor F in the dishwasher cavity 2. "Wash liquor" can be understood here to mean water containing a detergent and/or dirt particles removed from the items to be washed. The hydraulic circuit 17 comprises a number of spray zones 18, 19. The spray zones 18, 19 can be spray arms mounted in a rotatable manner in the dishwasher cavity 2, for instance. The spray zones 18, 19 can however also be what are known as intensive spray zones. Each spray zone 18, 19 has a plurality of spray nozzles for distributing fresh water and/or wash liquor F in the dishwasher cavity 2.

The spray zone 18 is connected fluidically with the pump device 16 with the aid of a supply line 20. The pump device 16 can apply fresh water and/or wash liquor F to the spray zone 18 by way of the supply line 20. The spray zone 19 is assigned a supply line 21, which connects the spray zone 19 fluidically with the pump device 16. The pump device 16 can apply fresh water and/or wash liquor F to the spray zone 19 by way of the supply line 21. Here each spray zone 18, 19 can be assigned a separate supply line 20, 21. Alternatively, both spray zones 18, 19 can also have a shared supply line, which splits into branches.

A water switch (not shown) can be provided between the pump device 16 and the supply lines 20, 21, which enables fresh water and/or wash liquor F to be supplied to either just one of the spray zones 18, 19 or simultaneously to both spray zones 18, 19. Furthermore, the supply lines 20, 21 or one of the supply lines 20, 21 can have a valve, in particular a switching valve, which enables the respective spray zone 18, 19 to be disconnected from the pump device 16. The valve can be a manually actuatable valve, for instance. The valve can also be actuated electronically, however.

A closure 22 which is manufactured from a water-soluble material can be provided in or on one of the two supply lines 20, 21. The closure 22 closes or blocks the supply line 20, 21, in or on which the closure 22 is arranged. The water-soluble material can be for instance a polyvinyl alcohol, a water-soluble salt, sugar, a water-soluble wax or suchlike. The closure 22 can comprise a mixture of different materials. Here water-insoluble materials, for instance as fillers, can also be combined with water-soluble materials.

The closure 22 can, as shown in FIG. 2, be provided in or on the supply line 21. The closure 22 can however also be provided in or on the supply line 20. The closure 22 makes it possible to disconnect part of the hydraulic circuit 17, here the spray zone 19, from the pump device 16. "Disconnect" is to be understood here to mean that on account of the closure 22 provided in or on the supply line 21, the pump device 16 cannot apply fresh water and/or wash liquor F to the spray zone 19. In other words, the spray zone 19 is separated fluidically from the pump device 16.

The functionality of the closure 22 is explained below. The control device 15 is suited to detecting a motor current I of the pump device 16 and, using the motor current I, concluding which of the spray zones 18, 19 is active. The pump device 16 consumes different motor currents I in the event that only the spray zone 18, only the spray zone 19 or both spray zones 18, 19 are active. In particular, the control device 15 can identify which of the spray zones 18, 19 is active on the basis of a motor current difference or a motor current delta.

To this end, however, a calibration or a calibration process of the household dishwasher 1 is required during commissioning. With the aid of the calibration, it is ensured that a reliable identification of which of the spray zones 18, 19 is active is possible. This calibration is carried out in a defined hydraulic state of the household dishwasher 1. This defined hydraulic state is achieved in that part of the hydraulic circuit 17 is disconnected from the pump device 16 with the aid of the closure 22. Here, the calibration is carried out in such a way that the spray zone 18 is active and the spray zone 19 is inactive. This means that the closure 22 disconnects the spray zone 19 from the pump device 16. This disconnection is carried out here without the assistance of a user. After or during the calibration process, the closure 22 dissolves in the fresh water and/or the wash liquor F.

With the aid of the closure 22, it is ensured that a user does not unintentionally activate both spray zones 18, 19 when the household dishwasher 1 is commissioned. The closure 22 slowly dissolves upon contact with fresh water and/or wash liquor F so that both spray zones 18, 19 can be activated after completion of the calibration process. The calibration process of the household dishwasher 1 can therefore be carried out in a defined hydraulic state, irrespective of whether the spray zone 19 is active or inactive. The closure 22 then dissolves as a function of the temperature of the fresh water and/or the wash liquor F and the duration of the application of fresh water and/or wash liquor F. The time until the closure 22 dissolves can be influenced or controlled here for instance with the aid of its composition and/or a temperature control of the fresh water and/or the wash liquor F.

The calibration can therefore always be reliably carried out by a user independently of the setting of the respective spray zone 18, 19. This increases the robustness of the operation of the household dishwasher 1. The closure 22 can be introduced into the respective supply line 20, 21 while the hydraulic circuit 17 is being assembled, for instance. The closure 22 is also not destroyed by a valve assigned to the respective spray zone 18, 19 before the first wash cycle. As a result, the user benefits from a cost saving and simple operation.

Furthermore, no additional information label is required on the household dishwasher 1 to advise the user of the need to deactivate the spray zone 19. This results in a further cost saving and reduces waste. The calibration takes place without the assistance of the user during first commissioning. This results in simple operation. Because the calibration is carried out on the user's premises, it is possible to dispense with calibration in the final production. This produces a further cost saving.

Figure 3:
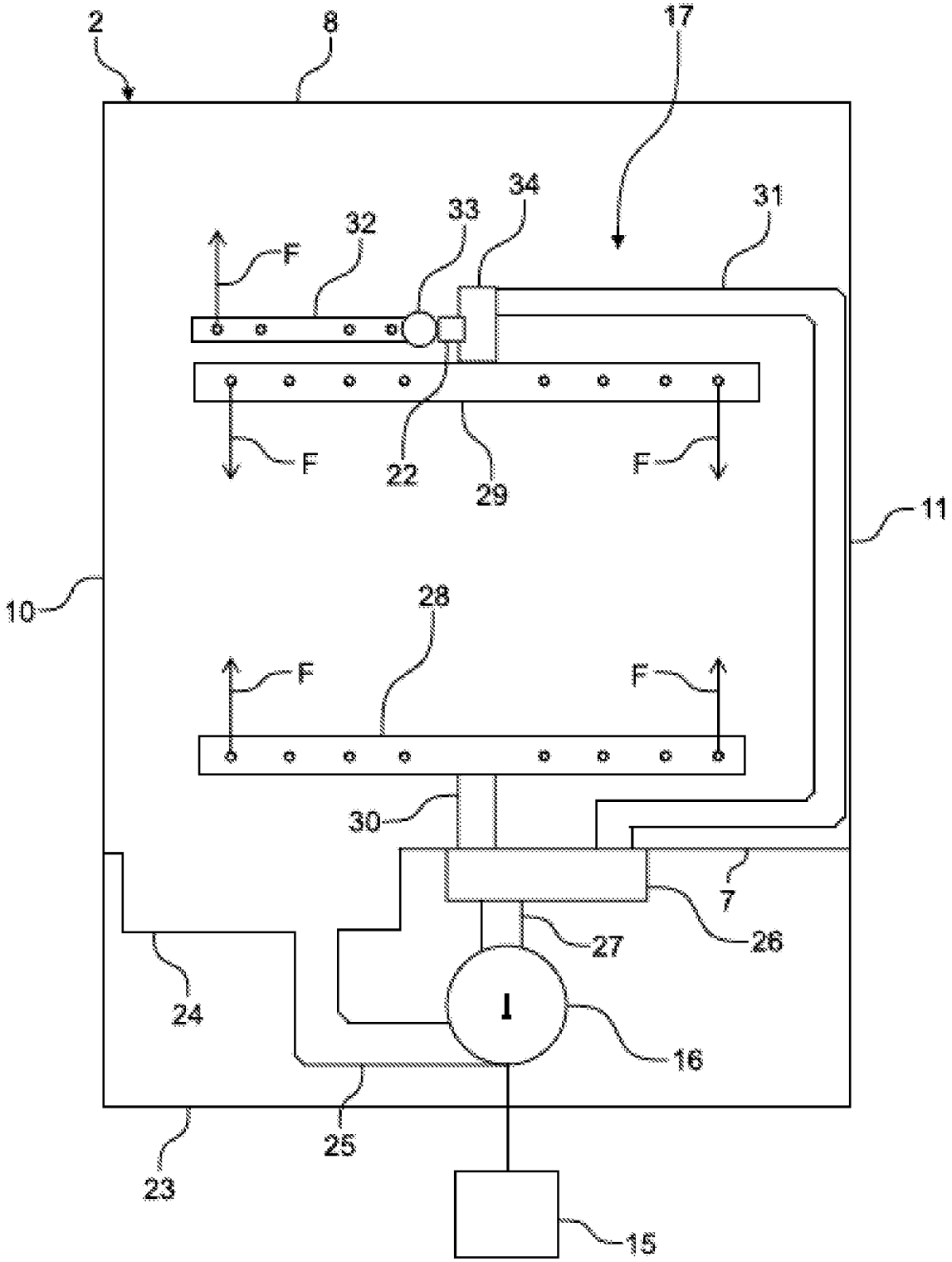
FIG. 3 shows a very schematic view of a further embodiment of a household dishwasher.

FIG. 3 shows a very schematic view of a further embodiment of a household dishwasher 1. Only differences compared with the household dishwasher 1 according to FIGS. 1 and 2 are discussed below. In addition to the dishwasher cavity 2, the household dishwasher 1 comprises a base carrier 23, which supports the dishwasher cavity 2. The base carrier 23 is a plastic component, in particular a plastic injection molded component, for instance.

A pump sump 24 is provided on the base 7. The pump device 16 is arranged on the pump sump 24. The pump device 16 can be connected to the pump sump 24 with the aid of a supply line 25, for instance. A water switch 26 is provided downstream of the pump device 16. The water switch 26 is coupled to the pump device 16 with the aid of a supply line 27 for instance.

The household dishwasher 1 still comprises a hydraulic circuit 17, as explained previously. The hydraulic circuit 17 comprises a spray zone 28, which is embodied as a spray arm mounted rotatably in the dishwasher cavity 2. The hydraulic circuit 17 further comprises a further spray zone 29, which is likewise embodied as a spray arm provided in a rotatable manner in the spray container 2. Each spray zone 28, 29 comprises a plurality of spray nozzles for uniformly distributing fresh water and/or wash liquor F in the dishwasher cavity 2.

The spray zone 28 is assigned to the receptacle 12 for items to be washed and the spray zone 29 is assigned to the receptacle 13 for items to be washed, for example. The spray zone 28 is coupled to the water switch 26 with the aid of a supply line 30. The spray zone 29 is coupled to the water switch 26 with the aid of a supply line 31. Either only the spray zone 28, only the spray zone 29 or both spray zones 28, 29 simultaneously can be applied with fresh water and/or wash liquor F with the aid of the water switch 26, for instance during the course of a wash program.

Furthermore, the hydraulic circuit 17 comprises a further spray zone 32, which is embodied as what is known as an intensive spray zone. The spray zone 32 also comprises a plurality of spray nozzles. For instance, the spray zone 32 can be fastened to the receptacle 13 for items to be washed. The spray zone 32 is likewise coupled fluidically with the pump device 16 by way of the supply line 31. In this case, however, a valve 33 is provided between the supply line 31 and the spray zone 32, with the aid of which the spray zone 32 can be fluidically disconnected from and reconnected again with the hydraulic circuit 17. The valve 33 can be actuated in particularly manually by a user so that he or she can deactivate and activate the spray zone 32. The valve 33 is a switching valve. In other words, the valve 33 is either opened fully or closed fully. The valve 33 can be an on-off valve.

A closure 22 made from a water-soluble material, as previously mentioned, is provided upstream of the valve 33. The closure 22 can be provided on or in a distribution element 34, which is suited to distributing the fresh water and/or the wash liquor F onto the spray zones 29, 32. The closure 22 can however also be provided downstream of the valve 33. "Upstream" here means arranged in a flow direction of the fresh water and/or wash liquor F viewed in front of the valve 33. "Downstream" here means arranged in the flow direction of the fresh water and/or wash liquor F viewed behind the valve 33.

The functionality of the household dishwasher 1 according to FIG. 3 corresponds substantially to the functionality of the household dishwasher 1 according to FIGS. 1 and 2. In order, during operation of the household dishwasher 1 with the aid of the control device 15, to be able to detect whether the manually actuatable spray zone 32 is active or inactive, it is necessary to calibrate the household dishwasher 1. This calibration takes place, as mentioned previously, in a defined hydraulic state.

This defined hydraulic state can be achieved by the spray zone 32 being deactivated during the commissioning or the calibration of the household dishwasher 1. This deactivation is ensured by the closure 22. The switch position of the valve 33 is irrelevant here for the deactivation of the spray zone 32 during the commissioning of the household dishwasher 1. With the calibration, with the aid of actuation of the water switch 26 by way of the control device 15, a calibration can take place during operation of the spray zone 29, the spray zone 28 or both spray zones 28, 29. After concluding the calibration or during the calibration, the closure 22 dissolves. The operating state of the spray zone 32 can be identified after calibration with the aid of a change in the motor current I.

Figure 4:
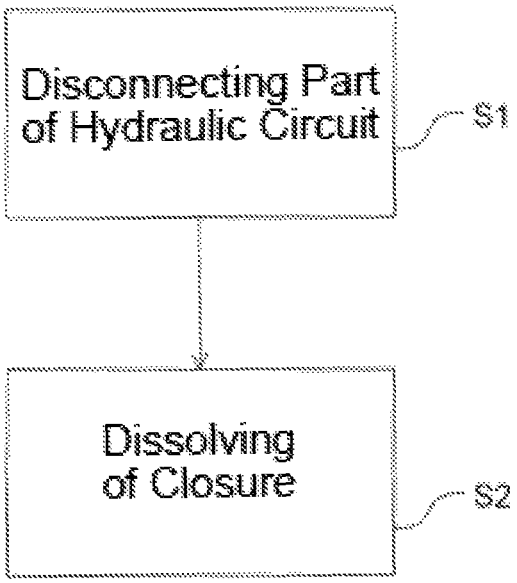
FIG. 4 shows a schematic block diagram of an embodiment of a method for calibrating the household dishwasher according to FIG. 1 or FIG. 3.

FIG. 4 shows a schematic block diagram of an embodiment of a method for calibrating the household dishwasher 1 according to FIGS. 1 and 2 and the household dishwasher 1 according to FIG. 3.

In a step S1, part of the hydraulic circuit 17 is disconnected from the pump device 16 during a one-time calibration process of the household dishwasher 1 with the aid of the closure 22 manufactured from a water-soluble material. The closure 22 subsequently or simultaneously dissolves in the fresh water and/or the wash liquor F during and/or after completion of the calibration process.

In particular, in step S2 the closure 22 dissolves as a function of a temperature of the fresh water and/or the wash liquor F and/or a duration of a contact between the closure 22 and the fresh water and/or the wash liquor F. In step S1, at least one of the spray zones 19, 32 of a number of the spray zones 18, 19, 28, 29, 32 of the hydraulic circuit 17 is disconnected from the pump device 16 with the aid of the closure 22. Furthermore, in step S1, the closure 22 is arranged in or on one of the supply lines 21, 31 of the at least one spray zone 19, 32 disconnected from the pump device 16 with the aid of the closure 22.

Although the present invention has been described with reference to exemplary embodiments, it can be modified in numerous different ways.

The invention claimed is:

1. A household dishwasher, comprising:

a dishwasher cavity for receiving an item to be washed;

a hydraulic circuit configured to circulate fresh water and/or wash liquor in the dishwasher cavity;

a pump device configured to apply fresh water and/or wash liquor to the hydraulic circuit; and a closure manufactured from a water-soluble material, said closure configured to disconnect part of the hydraulic circuit from the pump device during a one-time calibration process of the household dishwasher and dissolving in the fresh water and/or the wash liquor during and/or after completion of the calibration process.

2. The household dishwasher of claim 1, wherein the hydraulic circuit includes a number of spray zones, said closure disconnecting at least one spray zone of the spray zones from the pump device.

3. The household dishwasher of claim 2, further comprising a valve to bring the at least one spray zone from an activated state into a deactivated state.

4. The household dishwasher of claim 3, wherein the closure is arranged upstream of the valve.

5. The household dishwasher of claim 2, wherein the at least one spray zone is a targeted spray zone disconnected from other spray zones of the number of spray zones.

6. The household dishwasher of claim 2, wherein the at least one spray zone and a further one of the spray zones are connected to the pump device via a shared supply line.

7. The household dishwasher of claim 6, wherein the closure is arranged between the at least one spray zone and the shared supply line.

8. The household dishwasher of claim 2, further comprising a water switch arranged downstream of the pump device for activating and deactivating the spray zones.

9. The household dishwasher of claim 1, further comprising a control device configured to detect a motor current of the pump device during the calibration process.

10. The household dishwasher of claim 1, wherein the water-soluble material of the closure is a water-soluble plastic material.

11. The household dishwasher of claim 10, wherein the water-soluble plastic material is polyvinyl alcohol.

12. A method for calibrating a household dishwasher which comprises a dishwasher cavity for receiving an item to be washed, a hydraulic circuit for circulating fresh water and/or wash liquor in the dishwasher cavity, and a pump device for applying fresh water and/or wash liquor to the hydraulic circuit, said method comprising:

disconnecting part of the hydraulic circuit from the pump device during a one-time calibration process of the household dishwasher with a closure manufactured from a water-soluble material; and dissolving the closure in the fresh water and/or the wash liquor during and/or after completion of the calibration process.

13. The method of claim 12, wherein the closure dissolves as a function of a temperature of the fresh water and/or the wash liquor and/or a duration of a contact of the closure with the fresh water and/or the wash liquor.

14. The method of claim 12, wherein part of the hydraulic circuit is disconnected from the pump device by disconnecting with the closure at least one spray zone of a number of spray zones of the hydraulic circuit from the pump device.

15. The method of claim 14, further comprising arranging the closure in or on a supply line of the at least one spray zone which has been disconnected by the closure from the pump device.

16. The method of claim 12, further comprising detecting with a control device a motor current of the pump device during the calibration process.

* * * * *